US009301064B2

(12) United States Patent
Richardson et al.

(10) Patent No.: US 9,301,064 B2
(45) Date of Patent: Mar. 29, 2016

(54) HEARING AID REMOVAL HANDLE

(71) Applicant: Starkey Laboratories, Inc., Eden Prairie, MN (US)

(72) Inventors: Janet Richardson, Eden Prairie, MN (US); Toto Saykeo, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/087,482

(22) Filed: Nov. 22, 2013

(65) Prior Publication Data

US 2015/0146901 A1 May 28, 2015

(51) Int. Cl.
*H04R 25/00* (2006.01)

(52) U.S. Cl.
CPC ..... *H04R 25/65* (2013.01); *H04R 25/60* (2013.01); *H04R 25/602* (2013.01); *H04R 25/556* (2013.01); *H04R 2225/31* (2013.01); *H04R 2225/61* (2013.01); *H04R 2460/03* (2013.01); *H04R 2460/17* (2013.01)

(58) Field of Classification Search
CPC ..... H04R 25/602; H04R 2225/31; H04R 2225/61; H04R 25/556; H04R 25/60; H04R 25/65; H04R 2460/17
USPC ..... 381/323
See application file for complete search history.

(56) References Cited

U.S. PATENT DOCUMENTS

| | | | | |
|---|---|---|---|---|
| 4,565,904 | A | 1/1986 | Harada | |
| 5,784,470 | A * | 7/1998 | Fackler | H04R 25/602 381/328 |
| 6,055,319 | A * | 4/2000 | Shennib et al. | 381/328 |
| 2007/0121980 | A1 * | 5/2007 | Menzl | H04R 25/656 381/328 |

* cited by examiner

*Primary Examiner* — Duc Nguyen
*Assistant Examiner* — Sean H Nguyen
(74) *Attorney, Agent, or Firm* — Schwegman Lundberg & Woessner, P.A.

(57) ABSTRACT

A removal handle design for a hearing aid is described in which the removal handle is attached to the battery door of the hearing aid. By locating the removal handle in the battery door, the removal handle may be added as the last step in the manufacturing process, thus ensuring no damage from cutting/beveling/buffing equipment. The design also eliminates interference with the opening and closing of the battery door.

14 Claims, 3 Drawing Sheets

HEARING AID REMOVAL HANDLE

FIELD OF THE INVENTION

This invention pertains to electronic hearing aids and methods for their construction.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. In certain types of hearing aids, the electronic components are enclosed by housing that is designed to be worn in the ear for both aesthetic and functional reasons. Such devices may be referred to as in-the-ear (ITE), in-the-canal (ITC), completely-in-the-canal (CIC) type, or invisible-in-the-canal (IIC) hearing aids. These types of hearing aids are typically equipped with a handle attached to the housing that enables the wearer to easily remove the hearing aid from the ear.

DETAILED DESCRIPTION

Current designs for hearing aid removal handles are subject to numerous problems. The handles may break, necessitating that the hearing aid be returned to the manufacturer for repair. In some cases a patient may even have to go to a doctor to have the hearing aid removed from the ear. Also, the position of the removal handle on the hearing aid may cause interference with the opening and closing of battery door. Removal handles are also typically attached directly to the faceplate of the hearing aid during the manufacturing process. Subsequent steps in the manufacturing process, such as cutting/beveling/buffing, may damage and weaken the removal handle.

As described below, theses problems may be ameliorated by a removal handle design in which the removal handle is attached to the battery door of the hearing aid. By locating the removal handle in the battery door, the removal handle may be added as the last step in the manufacturing process, thus ensuring no damage from cutting/beveling/buffing equipment. The design also eliminates interference with the opening and closing of the battery door. The removal handle may be easily changed in the field if needed by simply changing the battery door. Different length removal handles can be made to accommodate different patients.

Figure 1:
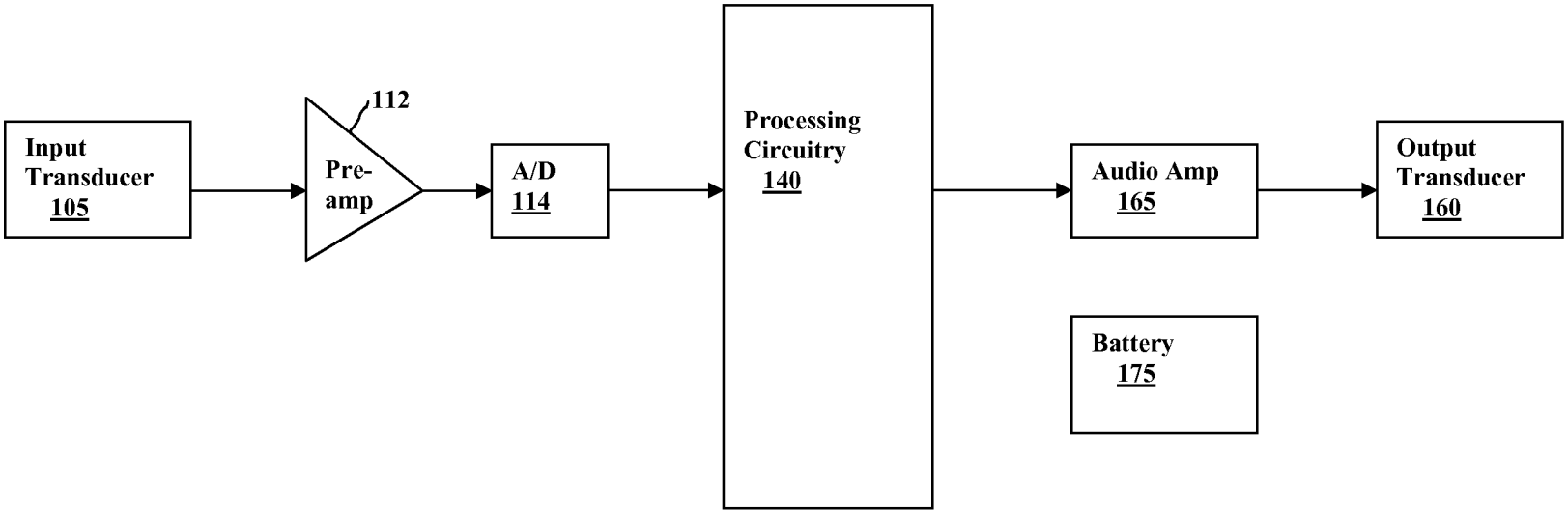
FIG. 1 shows the basic electronic components of an example hearing aid.

FIG. 1 illustrates the basic functional components of an example hearing aid. The electronic circuitry of a typical hearing aid is contained within a housing that is commonly either placed in the external ear canal or behind the ear. A microphone or other input transducer 105 receives sound waves from the environment and converts the sound into an input signal. After amplification by pre-amplifier 112, the input signal is sampled and digitized by A/D converter 114 to result in a digitized input signal. The device's processing circuitry 100 processes the digitized input signal into an output signal in a manner that compensates for the patient's hearing deficit. The output signal is then passed to an audio amplifier 165 that drives an output transducer 160 or receiver for converting the output signal into an audio output. A battery 175 supplies power for the electronic components.

Figure 2:
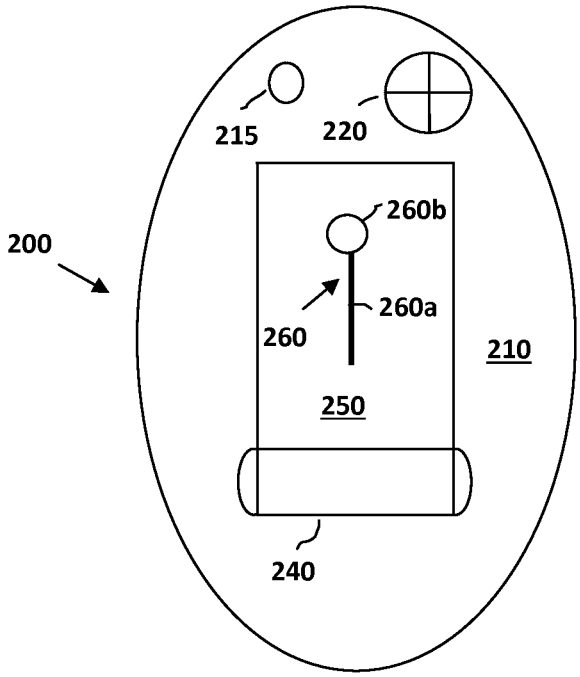
FIG. 2 shows a top view of the housing of an example hearing aid.
Figure 3:
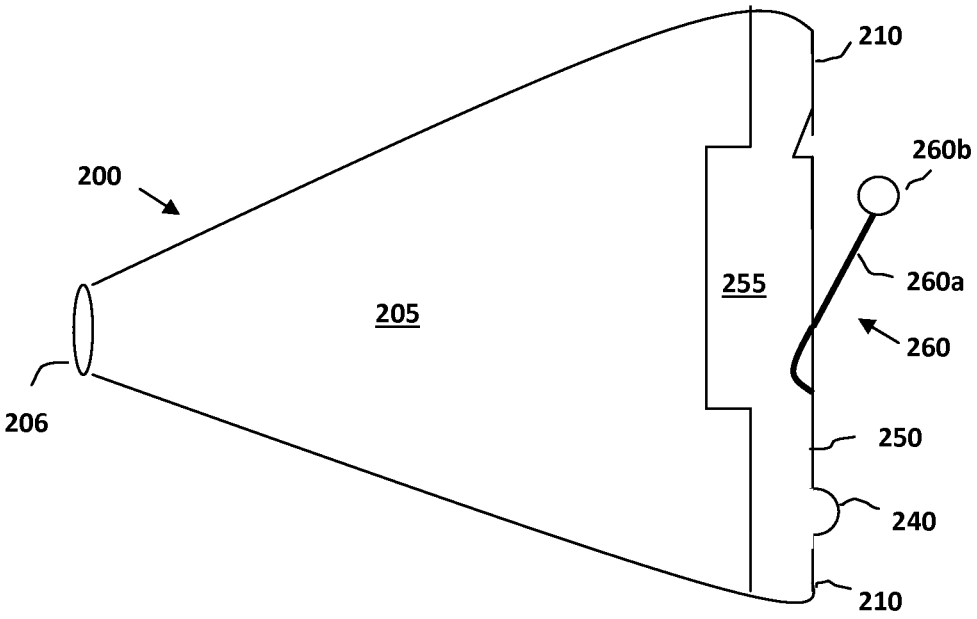
FIGS. 3 and 4 depict cross-sectional views of the housing shown in FIG. 2.

FIGS. 2 and 3 show a top view and a cross-sectional side view, respectively, of an example housing or enclosure 200 for a hearing aid. The cross-section of FIG. 3 is taken vertically through approximately the middle of FIG. 2. The enclosure is made up of an ear mold 205, within which are housed the electronic components the electronic components described above with reference to FIG. 1, and a faceplate 210. At the end of the ear mold opposite the faceplate is an outlet port 206 for the receiver to convey sound to the wearer's ear. The faceplate includes a status indicator light 215 and a microphone inlet port 220. Also hingedly mounted on the faceplate via hinge 240 is a battery door 250 that opens into a battery compartment 255 to allow replacement of the battery 175. The battery door may be seated underneath a portion of the faceplate via tabs or other extension to secure it in a closed position. An indentation on the faceplate may allow the user to pop the battery door open when access to the battery compartment is needed. Affixed to the battery door 250 is a removal handle 260 that is made up of an elongated portion 260*a* and a bulbous portion 260*b* at its end.

Figure 4:
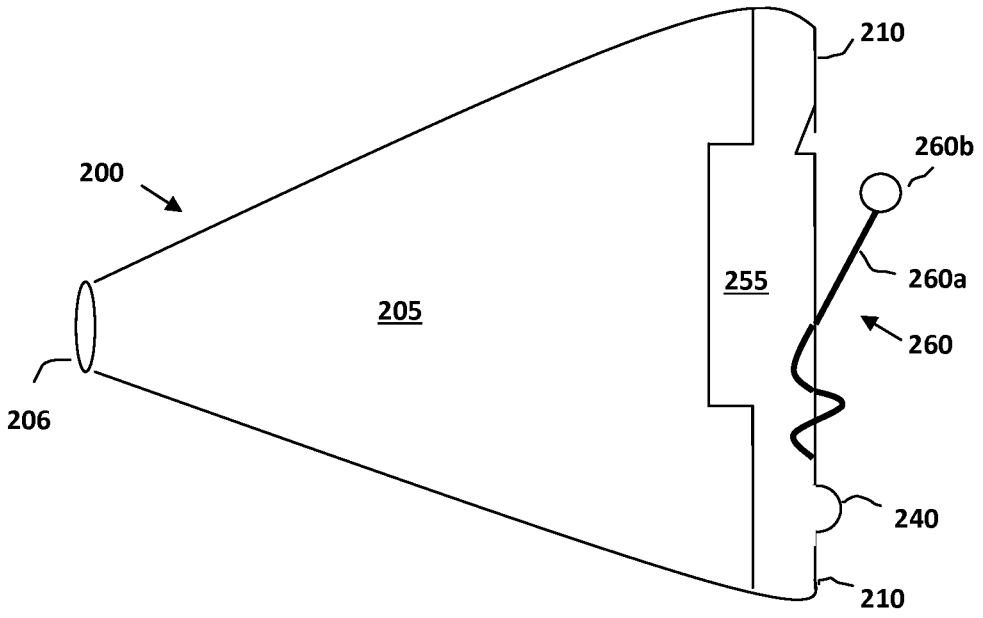

The elongated portion 260*a* of the removal handle may be a flexible structure such as a monofilament line. In the embodiment shown in FIG. 3, the elongated portion 260*a* is passed through a hole in the battery door and then attached to the underside of the battery door to secure it. In an alternative embodiment, illustrated by FIG. 4, the elongated portion 260*a* is double-looped through two additional holes and attached to the underside of the battery door. The battery door may be secured in a closed position by means of extensions or otherwise as discussed above to prevent opening of the door when the removal handle is pulled upon. As illustrated by the embodiments of both FIGS. 3 and 4, the removal handle may also be attached to the battery door nearer the hinge than to the opposite top end of the door and then angled toward the top end. Attaching the removal handle in this way further lessens the chance that the battery door will be opened when a pulling force is exerted on the removal handle.

Example Embodiments

In one embodiment, a housing or enclosure for a hearing aid, comprises: an earmold for containing electronic components of the hearing aid; a faceplate attached to the earmold; a battery door hingedly mounted on the faceplate opening into a battery compartment; and, a removal handle attached to the battery door. The removal handle may comprise a flexible elongated portion and a bulbous portion with the elongated portion attached to the battery door. The elongated portion of the removal handle may be a monofilament line. The elongated portion may be passed through a hole in the battery door and attached to the underside of the battery door and may be adhesively attached to the underside of the battery door. The elongated portion may be double-looped through holes in the battery door and attached to the underside of the battery door. The battery door may be adapted to be seated underneath a portion of the faceplate via tabs or another type of extension to secure it in a closed position. The faceplate may comprise an indentation that allows a user to pop the battery door open when access to the battery compartment is needed. The elongated portion of the removal handle may be attached to the battery door at a location nearer the battery door's hinged connection with the faceplate than to the opposite end of the battery door. The elongated portion of the removal handle may be angled away from the battery door's hinged connection.

In one embodiment, a method for constructing a housing or enclosure for a hearing aid, comprises: attaching a faceplate to an earmold for containing electronic components of the hearing aid; hingedly mounting a battery door on the faceplate opening into a battery compartment; attaching a removal handle to the battery door. The removal handle may comprise a flexible elongated portion and a bulbous portion with the elongated portion attached to the battery door. The elongated portion of the removal handle may be a monofilament line. The method may further comprise passing the elongated portion through a hole in the battery door and attaching it to the underside of the battery door. The method may further comprise adhesively attaching the elongated portion to the underside of the battery door. The method may further comprise double-looping the elongated through holes in the battery door and attaching it to the underside of the battery door. The battery door may be adapted to be seated underneath a portion of the faceplate via tabs or another type of extension to secure it in a closed position. The faceplate may comprise an indentation that allows a user to pop the battery door open when access to the battery compartment is needed. The method may further comprise attaching the elongated portion of the removal handle to the battery door at a location nearer the battery door's hinged connection with the faceplate than to the opposite end of the battery door. The method may further comprise locating the elongated portion of the removal handle so as to be angled away from the battery door's hinged connection.

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to, cochlear implant type hearing devices, hearing aids, such as behind-the-ear (BTE), in-the-ear (ITE), in-the-canal (ITC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user. Such devices are also known as receiver-in-the-canal (RIC) or receiver-in-the-ear (RITE) hearing instruments. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A housing for a hearing aid, comprising:

an earmold for containing electronic components of the hearing aid;

a faceplate attached to the earmold;

a battery door opening into a battery compartment and hingedly mounted on the faceplate via a hinge, the battery door having an exterior side facing outwardly and an interior side facing toward the battery compartment;

a flexible and elongated removal handle that passes through a hole in the battery door from the exterior side to the interior side and is attached to the interior side of the battery door, wherein the hole is located nearer the battery door's hinged connection with the faceplate than to the opposite end of the battery door; and, wherein the battery door is adapted to be seated underneath a portion of the faceplate via extensions to secure the battery door in a closed position unless the battery door is popped open via an indentation in the faceplate.

2. The housing of claim 1 wherein the removal handle comprises a flexible elongated portion and a bulbous portion with the elongated portion attached to the battery door.

3. The housing of claim 2 wherein the elongated portion of the removal handle is a monofilament line.

4. The housing of claim 1 wherein the elongated portion is adhesively attached to the underside of the battery door.

5. The housing of claim 2 wherein the elongated portion is double-looped through holes in the battery door and attached to the underside of the battery door.

6. The housing of claim 1, wherein the faceplate comprises said indentation that allows a user to pop the battery door open when access to the battery compartment is needed.

7. The housing of claim 2 wherein the elongated portion of the removal handle is attached to the battery door at a location nearer the battery door's hinged connection with the faceplate than to the opposite end of the battery door.

8. A method for constructing a housing for a hearing aid, comprising:

attaching a faceplate to an earmold for containing electronic components of the hearing aid;

hingedly mounting a battery door opening into a battery compartment on the faceplate via a hinge, the battery door having an exterior side facing outwardly and an interior side facing toward the battery compartment;

passing a flexible and elongated removal handle through a hole in the battery door and attaching the removal handle to the interior side of the battery door, wherein the hole is located nearer the battery door's hinged connection with the faceplate than to the opposite end of the battery door; and, wherein the battery door is adapted to be seated underneath a portion of the faceplate via extensions to secure the battery door in a closed position unless the battery door is popped open via an indentation in the faceplate.

9. The method of claim 8 wherein the removal handle comprises a flexible elongated portion and a bulbous portion with the elongated portion attached to the battery door.

10. The method of claim 9 wherein the elongated portion of the removal handle is a monofilament line.

11. The method of claim 8 further comprising adhesively attaching the elongated portion to the underside of the battery door.

12. The method of claim 9 further comprising double-looping the elongated through holes in the battery door and attaching it to the underside of the battery door.

13. The method of claim 8, wherein the faceplate comprises said indentation that allows a user to pop the battery door open when access to the battery compartment is needed.

14. The method of claim 9 further comprising attaching the elongated portion of the removal handle to the battery door at a location nearer the battery door's hinged connection with the faceplate than to the opposite end of the battery door.

* * * * *